US009640341B2

(12) United States Patent
Hoepfl et al.

(10) Patent No.: US 9,640,341 B2
(45) Date of Patent: May 2, 2017

(54) ON-LOAD TAP CHANGER

(71) Applicant: Maschinenfabrik Reinhausen GmbH, Regensburg (DE)

(72) Inventors: Klaus Hoepfl, Maxhuette-Haidhof (DE); Silke Wrede, Zeitlarn (DE); Dieter Dohnal, Lappersdorf (DE); Christian Kotz, Schorndorf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/899,377

(22) PCT Filed: Jun. 24, 2014

(86) PCT No.: PCT/EP2014/063256
§ 371 (c)(1),
(2) Date: Dec. 17, 2015

(87) PCT Pub. No.: WO2015/007473
PCT Pub. Date: Jan. 22, 2015

(65) Prior Publication Data

US 2016/0181025 A1 Jun. 23, 2016

(30) Foreign Application Priority Data

Jul. 16, 2013 (DE) ..... 10 2013 107 552

(51) Int. Cl.
*H01H 9/16* (2006.01)
*H01H 9/00* (2006.01)

(52) U.S. Cl.
CPC ..... *H01H 9/0038* (2013.01); *H01H 9/0016* (2013.01); *H01H 9/0044* (2013.01); *H01H 2009/0022* (2013.01)

(58) Field of Classification Search
CPC ..... H01H 9/0016; H01H 2009/0022; H01H 9/0027; H01H 9/0044; H01H 9/0038;
(Continued)

(56) References Cited

U.S. PATENT DOCUMENTS 2,217,595 A * 10/1940 Morgan ..... H05B 3/82 219/510
2,513,918 A * 7/1950 Coggeshall ..... H01H 33/165 218/115

(Continued)

FOREIGN PATENT DOCUMENTS

DE 3226854 A 1/1984
DE 4231353 A 4/1993

(Continued)

*Primary Examiner* — Edwin A. Leon
(74) *Attorney, Agent, or Firm* — Andrew Wilford

(57) ABSTRACT

An on-load tap changer has a load changeover switch insert having a switching tube rotatable about an axis, at least one switching module associated with the switching insert and having at least one switching segment fastened to the switching tube, an oil tank, and a resistor subassembly having a plurality of separate and identical resistors. An actuating arrangement associated with the switching module at an inner wall of the oil tank has a plurality of identical actuators associated with the switching module at the inner wall of the oil tank. The on-load tap changer is a load selector or a load changeover switch depending on the arrangement of the at least one identical switching segment, the resistor subassembly, and the mounting of the plurality of identical actuators at the inner wall of the oil tank.

15 Claims, 10 Drawing Sheets

(58) Field of Classification Search
CPC ..... H01H 3/3052; H01H 9/0033; H01H 3/44; H01H 3/40; F16H 19/02; Y10T 74/18792; H02K 11/0042; H02K 7/1166; H02K 7/1004
USPC ..... 200/11 TC, 571, 275, 61.54, 504, 11 G; 218/147; 333/107, 262; 338/215; 336/127, 65, 137, 146–150, 141, 142; 322/71; 323/255, 256, 341, 342, 323/355–359; 29/622; 251/147
See application file for complete search history.

(56) References Cited

U.S. PATENT DOCUMENTS

| | | | | |
|---|---|---|---|---|
| 3,194,900 | A | 7/1965 | Bleibtreu | |
| 4,978,815 | A | 12/1990 | Berger | |
| 5,107,200 | A | 4/1992 | Dohnal | |
| 5,786,552 | A | 7/1998 | Dohnal | |
| 5,834,717 | A | 11/1998 | Neymeyer | |
| 8,947,188 | B2 * | 2/2015 | Hammer | H01F 29/04 218/10 |

FOREIGN PATENT DOCUMENTS

| | | | |
|---|---|---|---|
| DE | 10055406 | | 4/2002 |
| DE | 102007004530 | A | 9/2007 |
| DE | 102011014325 | A | 9/2012 |
| GB | 636276 | A | 4/1950 |
| JP | 03289111 | B | 12/1991 |

* cited by examiner

ON-LOAD TAP CHANGER

CROSS REFERENCE TO RELATED APPLICATIONS

This application is the US-national stage of PCT application PCT/EP2014/063256 filed 24 Jun. 2014 and claiming the priority of German patent application 102013107552.5 itself filed 16 Jul. 2013.

FIELD OF THE INVENTION

The present invention relates to an on-load tap changer that comprises a load changeover switch insert and a switching tube rotatable about an axis and with which at least one switching module is associated. The switching module comprises at least one switching segment fastened to the switching tube and a resistor subassembly. At least one actuating arrangement is associated with the switching module at an inner wall of an oil tank.

BACKGROUND OF THE INVENTION

On-load tap changers (in abbreviation OLTC) are widely known and conventional in the prior art. They serve for uninterrupted changeover between different winding taps of tapped transformers.

Such on-load tap changers are divided into load selectors and load changeover switches with selectors.

In a load-changeover switch with a selector such as disclosed in, for example, German Patent Specification DE 100 55 406 the selector, which consists of a fine selector and possibly a preselector, is below the load changeover switch. The selector serves for power-free selection of the respective new winding tap to be switched over to, of the tapped transformer. The load changeover switch serves for the subsequent rapid and uninterrupted changeover from the connected to the new, preselected winding tap to be connected.

Load selectors such as described in, for example, German Patent Specification DE 28 33 126 serve, just like the load changeover switch with a selector, the purpose of switching over the taps of the regulating windings of these tapped transformers under load and thus of providing selective compensation for voltage changes at the user. Through dispensing with the separation of the load changeover switch from selector, load selectors can be produced at lower cost. Load selectors have only a limited range of use, such as, for example, due to the limited possible number of taps.

Both kinds of on-load tap changers are actuated by a motor drive for the changeover process. A drive output or drive input shaft, which loads a force-storing unit, is moved by the motor drive. When the force-storing unit is completely loaded, i.e. stressed, it is unlatched, abruptly releases its energy and actuates a load changeover switch insert in a space of milliseconds (ms) that in that case executes a specific switching sequence during the load changeover. Different switch contacts and resistance contacts are then actuated in a specific sequence in time. The switch contacts in that case serve for direct connection of the respective winding tap with the load diverter and the resistance contacts serve for temporary connection, i.e. bridging-over by one or more switching-over resistances. Advantageously, vacuum interrupters are used as switch elements for the load changeover. This is based on the fact that the use of vacuum interrupters for the load changeover prevents formation of arcs in the oil and thus oil contamination of the load changeover switch oil, such as described in, for example, German Patent Specifications DE 195 10 809 [U.S. Pat. No. 5,834,717] and DE 40 11 019 [U.S. Pat. No. 5,107,200] as well as German published specifications DE 42 31 353 and DE 10 2007 004 530 A1.

The centrally rotating transmission and the actuators as well as the stationary contact and resistor subassemblies are disadvantageous with these on-load tap changers. This is due to the fact that, for example, complex support elements are necessary for the switching segments or also the resistor subassembly and these elements have to be differently arranged in the load selector. Moreover, flexible contact or current connections are needed. Added to that is the fact that some components have to be produced precisely and free of distortion in such a way that they can be installed in the on-load tap changer. If these components were to be produced by an injection-molding process, an individual injection-molding tool would have to be made for each of the different components that increases the costs of an on-load tap changer.

Thus, German specification DE 1 231 805 B already discloses a tap selector for tap changers of regulating transformers preferably below a load changeover switch and is constructed in accordance with a modular principle so that the tap selector is capable of use for different tap changers.

The object of the invention is to create a simple and economic on-load tap changer that uses a large number of identical parts with respect to load selector or load changeover switch so that different functionalities of the on-load tap changer can be realized.

SUMMARY OF THE INVENTION

This object is fulfilled by an on-load tap changer according to the invention that comprises a load changeover switch insert and a switching tube rotatable about an axis. At least one switching module is associated with the switching tube. In that case, the switching module of the on-load tap changer comprises at least one switching segment fastened to the switching tube and a resistor subassembly. An actuator is associated with the switching module at an inner wall of an oil tank.

According to the invention the at least one resistor subassembly comprises a plurality of individual and identical resistors. In addition, it is provided that the actuating arrangement comprises a plurality of identical actuators that are associated with the switching module at the inner wall of the oil tank. In that case, depending on the arrangement of the at least one identical switching segment, the at least one resistor subassembly and the mounting of the plurality of identical actuators at the inner wall of the oil tank, the on-load tap changer is either a load selector or a load changeover switch. Since the individual components of the switching modules can be used not only for a load selector, but also for a load changeover switch, this on-load tap changer creates a large number of identical parts. These can then be combined in accordance with a modular principle as further described in the following. Through the use of these identical parts it is possible to save substantial production costs so that a more economic on-load tap changer is created.

In a first embodiment of the invention the identical resistors are respectively seated in a sector-shaped support and thus form an identical resistor subassembly appropriately in the load selector or load changeover switch so as to make possible the functionality of the load selector or load changeover switch.

In a further embodiment of the invention the identical actuators have a plurality of bores and a plurality of passages for fastening to the inner wall of the oil tank. In addition, the identical actuators are formed with an upper control cam and a lower control cam.

In particular, each switching segment can comprise two vacuum interrupters, with each of which a respective actuating lever is associated, and a plurality of movable contacts for the diverter contact and a plurality of movable contacts for the tap contacts in the load changeover switch or for the selector contacts in the load selector.

In a preferred embodiment of the on-load tap changer according to the invention a switching segment and a high-mass element are in the switching module of the sector-shaped support of the identical resistor subassembly around the axis of the switching tube. In addition, corresponding actuators are so mounted on the inner wall of the oil tank that the on-load tap changer according to the invention is a load selector in this embodiment.

In particular, in this embodiment of the on-load tap changer as a load selector the switching tube can carry a mount that carries a switching segment, a resistor subassembly and the high-mass element radially around the axis of the switching tube.

In a further preferred embodiment of the on-load tap changer according to the invention the sector-shaped supports of a plurality of identical resistor subassemblies are so arranged in the switching module around the axis of the switching tube that the resulting arrangement of the resistor subassemblies surrounds the switching tube. Three switching segments are mounted around the switching tube at a spacing from the arrangement of resistor subassemblies in the direction of the axis of the switching tube. In addition, corresponding actuators are so mounted on the inner wall of the oil tank that the on-load tap changer according to the invention is a load changeover switch suitable for cooperating with a separate selector.

In particular, in this embodiment of the on-load tap changer as a load changeover switch the switching tube can carry a first mounting device for the resistor subassemblies so that these surround the switching tube. In that case, the switching tube carries, in axial direction, a second mounting device that carries the three associated switching segments around the switching tube.

Regardless of whether the on-load tap changer is a load selector or a load changeover switch with selector according to the invention each actuating lever of the switching segment carries a roller that cooperates with the upper control cam or the lower control cam of the actuators.

Equally, at least one diverter contact and at least one tap contact or selector contact can each be mounted on an inner surface of each actuator by a respective mounting element and on an outer wall of the oil tank. In that case, an electrical terminal element of the respective diverter contact or tap contact is then led through a screening cap to the outer wall of the oil tank.

In a further embodiment the diverter contact is a continuous wiper ring. This arises due to the arrangement of the at least one identical switching segment and the identical resistor subassemblies so that the on-load tap changer is constructed as a load selector and the diverter contact as a continuous diverter ring or wiper ring.

In a further embodiment the diverter contact consists of at least one separate wiper ring segment. This arises due to the arrangement of at least the identical switching segments and the identical resistor subassemblies so that the on-load tap changer is a load changeover switch and the diverter contact is a ring segment or a wiper ring segment.

In a further embodiment of the invention a flywheel mass is mounted on the switching tube. The flywheel mass preferably consists of a first part flywheel mass and a second part flywheel mass. In that case, the switching tube carries the first part flywheel mass and the second part flywheel mass. The division of the flywheel mass into the first part flywheel mass and the second part flywheel mass facilitate mounting thereof on the switching tube. In addition, the flywheel mass carries the high-mass element mentioned above with respect to the load selector.

In a further preferred embodiment the load selector comprises three switching modules arranged at the switching tube along the axis so that this is a three-phase load selector.

In another preferred embodiment the on-load tap changer comprises three switching modules radially around the axis so that this is a three-phase load changeover switch. Here, too, the switching tube carries the flywheel mass.

The flywheel mass, consisting of first part flywheel mass and second part flywheel mass, substantially serves the purpose of providing an appropriate mass so that the moment transmitted by the force-storing unit to the switching tube produces a defined pivot movement of the switching tube. It can thus be ensured that defined switching settings of the on-load tap changer are set.

BRIEF DESCRIPTION OF THE INVENTION

The invention and the advantages thereof are described in more detail in the following with reference to the accompanying drawings in which.

SPECIFIC DESCRIPTION OF THE INVENTION

Figure 1:
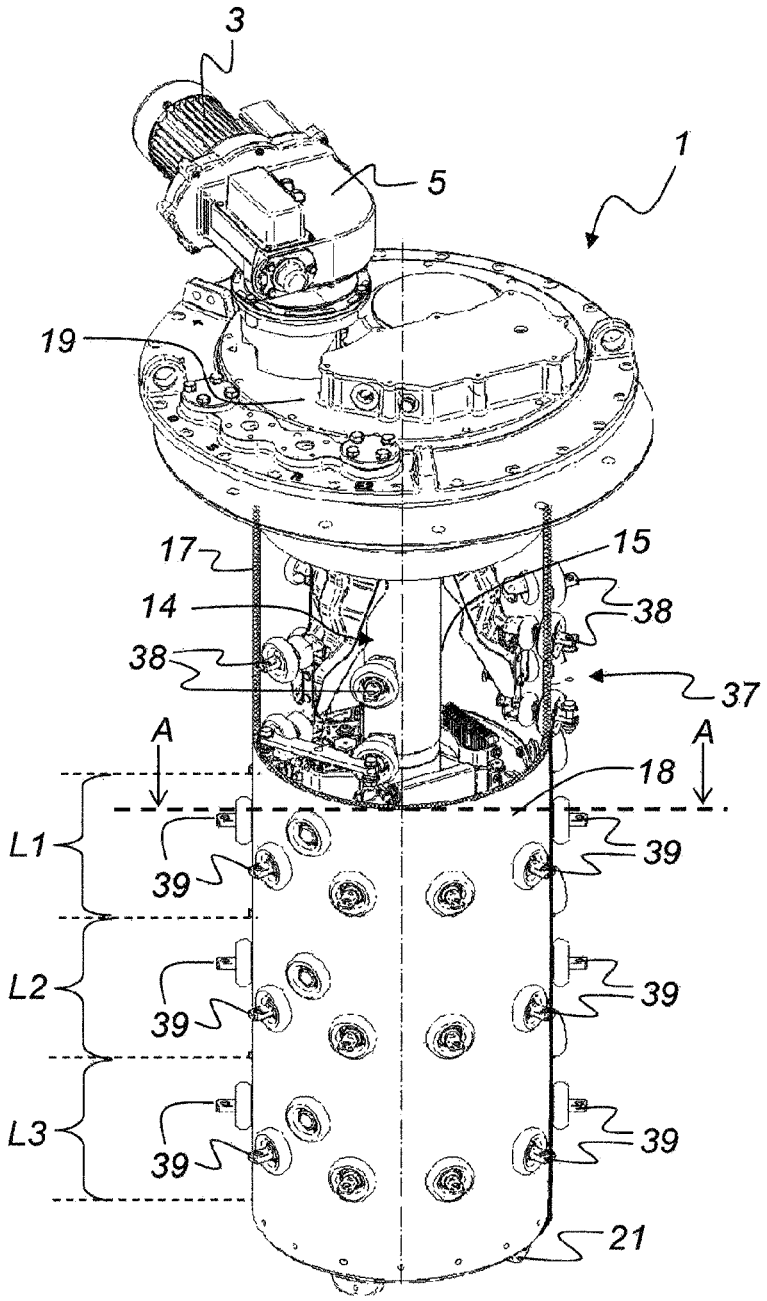
FIG. 1 is a perspective view of an on-load tap changer according to the invention in the form of a three-phase load selector.

Identical reference numerals are used for the same or equivalent elements of the invention. In addition, for the sake of clarity only reference numerals necessary for description of the respective figure are illustrated in the individual figures. The illustrated embodiments merely represent examples of how the on-load tap changer according to the invention can be designed and thus do not represent a definitive limitation of the invention.

FIG. 1 is a perspective view of a three-phase on-load tap changer or load selector 1 according to the invention. The load selector 1 comprises a drive 3 such as, for example, an electric motor, with a transmission that loads a force-storing unit (not illustrated). When the force-storing unit is fully loaded, i.e. stressed, it is unlatched, abruptly releases its energy and actuates a switching tube 15 of a load changeover switch insert 14. The rotating switching tube 15 is in that case mounted in an oil tank 18. The oil tank 18 is closed upwardly by a cover 19 and additionally carries a base 21.

The load selector 1 according to the invention has a first phase L1, a second phase L2 and a third phase L3 that are one above the other in the oil tank 18. A preselector 37 is seated above the three phases L1, L2, L3. In the view illustrated here, electrical terminal elements 38 for preselector contacts are provided at the oil tank wall 17 of the oil tank 18. Electrical terminal elements 39 for tap contacts 392 (see FIGS. 5 to 7) of the three phases L1, L2, L3 are equally so arranged at the load selector 1 that they pass through the oil tank wall 17 of the oil tank 18.

Figure 2:
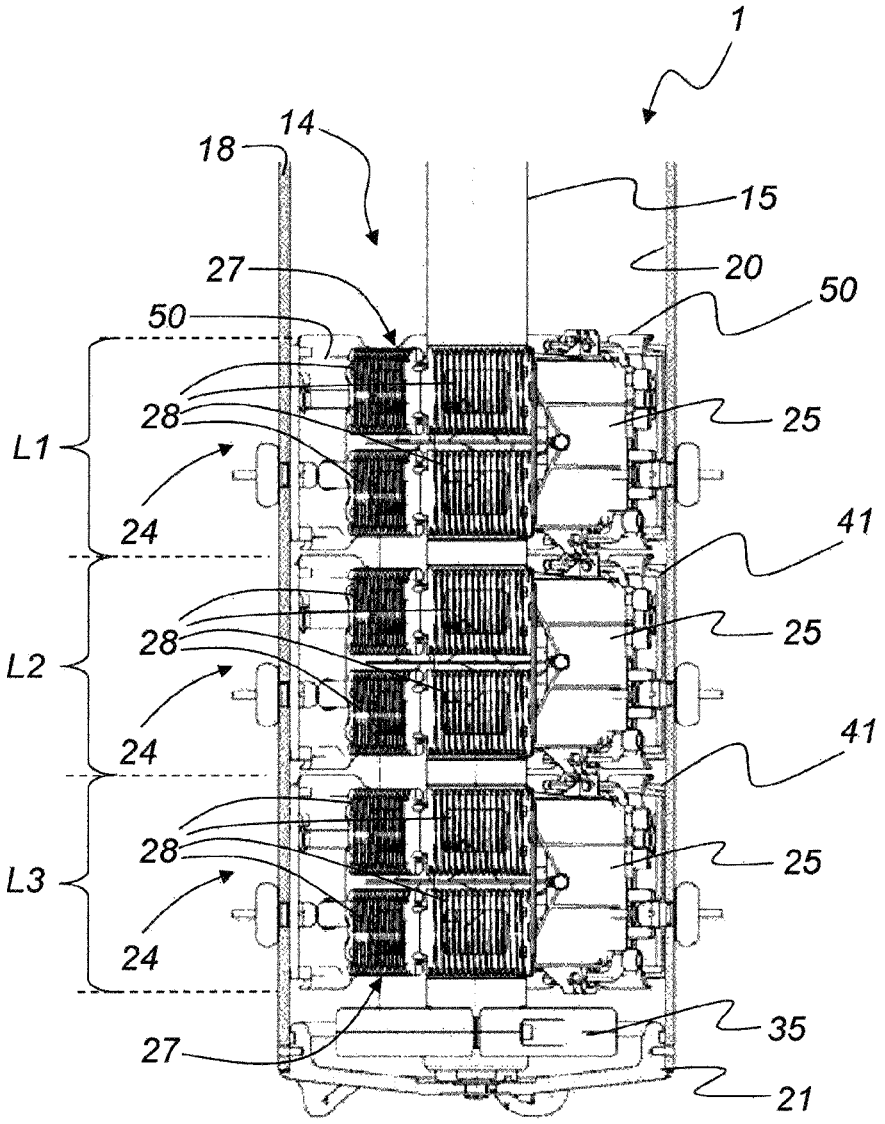
FIG. 2 is a sectional view of the load selector according to the invention in accordance with FIG. 1.
Figure 3:
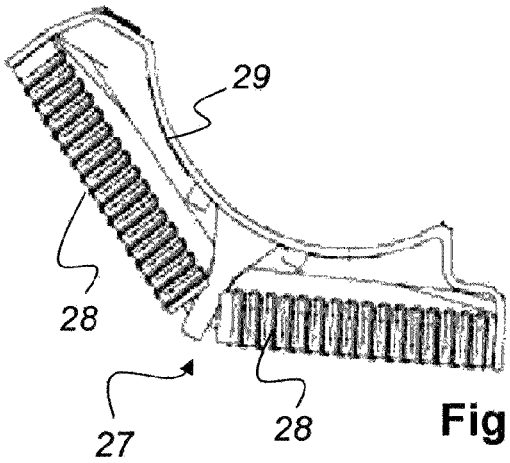
FIG. 3 is a plan view of a sector-shaped support, in which the identical resistors of the resistor subassembly are seated.

FIG. 2 is a sectional view of the load selector 1 according to the invention with load changeover switch insert 14 according to FIG. 1. The load changeover switch insert 14 comprises a switching tube 15 rotatable about an axis A. Here, three switching modules 24 according to the invention are associated with the switching tube 15, i.e. each phase L1, L2, L3 comprises a switching module 24. In that case, each switching module 24 of a load selector 1 comprises a switching segment 25 fastened to the switching tube 15 and at least one identical resistor subassembly 27 that comprises a plurality of individual and identical resistors 28. These identical resistors 28 are seated, as shown in FIG. 3, in a sector-shaped support 29 that forms, together with the resistors 28, the identical resistor subassembly 27.

In addition, as shown in FIG. 2, at least one actuator 50 is associated with each switching module 24 at an inner wall 20 of the oil tank 18. Each actuating arrangement 41 in that case comprises a plurality of separate and identical actuators 50. The actuators 50 are preferably matched to the contour of the inner wall 20 of the oil tank 18 and are substantially plate-shaped.

Figure 4:
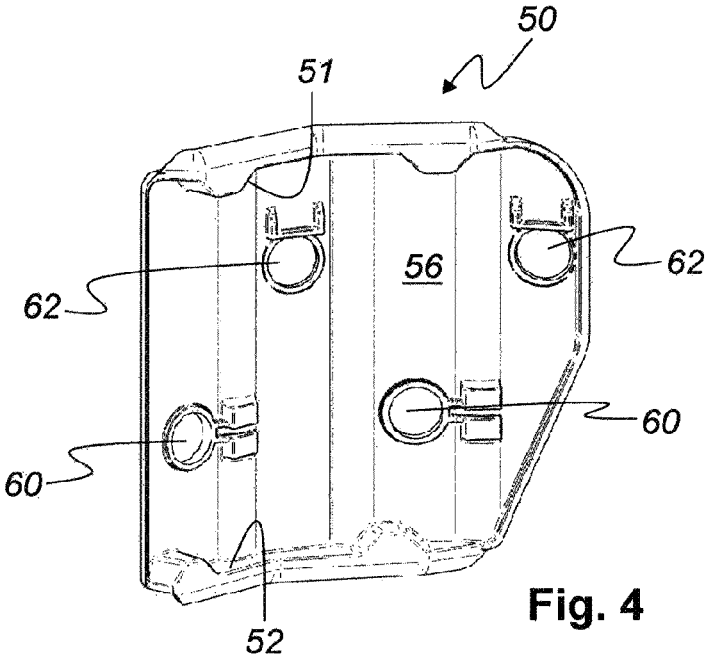
FIG. 4 is a perspective view of an individual actuator for the on-load tap changer according to the invention.

An individual actuator 50 of that kind is shown in a perspective view in FIG. 4. For fastening the actuator 50 to the inner wall 20 of the oil tank 18, as shown in the following FIG. 5, the actuator 50 has at least one bore 60 for mounting and passage of the electrical terminal elements 39 of the tap contacts 392 (see FIGS. 5, 7). In addition, each actuator 50 has at least one passage 62. The passages 62 serve for passage of at least two mounting elements 31 for the diverter ring 391 (see FIGS. 5, 7, 10) and, in the first phase L1 of the load selector, additionally for passage of a single electrical terminal element (not illustrated) for the diverter ring 391. Moreover, the actuator 50 has an upper control cam 51 and a lower control cam 52 that are used for actuation of the vacuum interrupters 33, 34 shown in FIG. 7.

Figure 5:
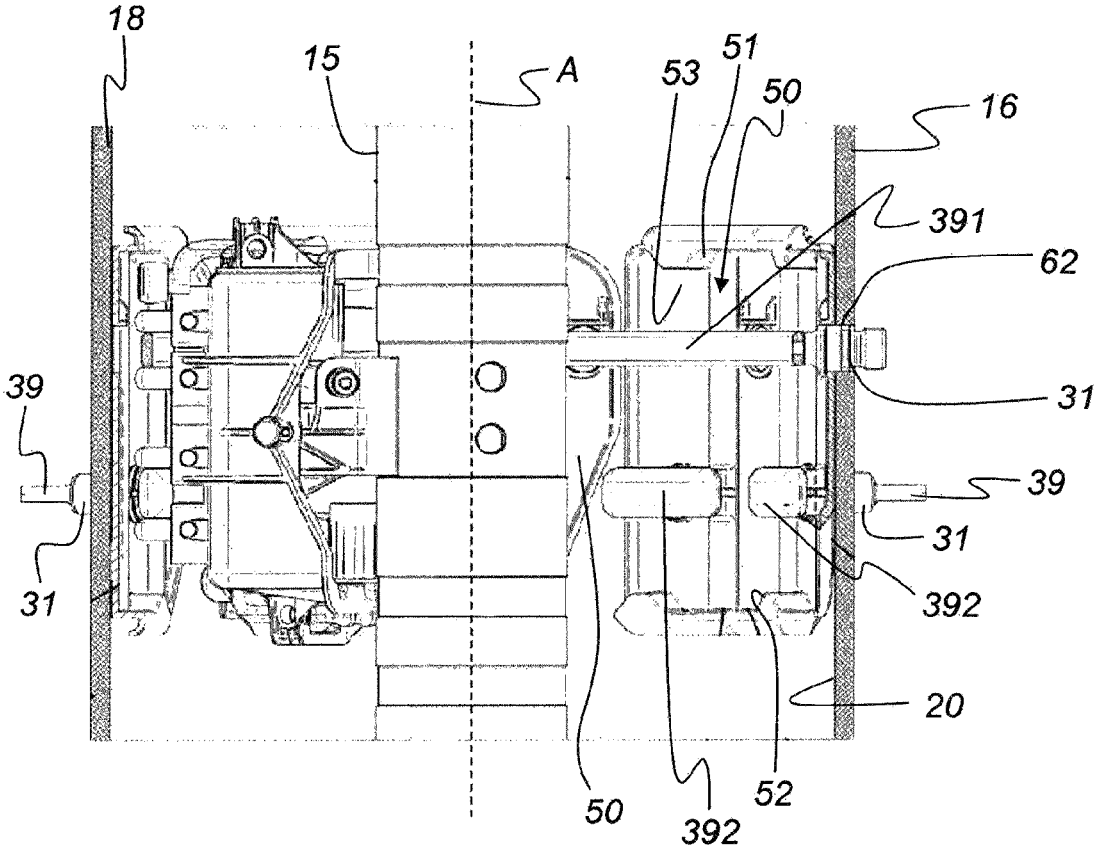
FIG. 5 is a sectional view of a detail of the on-load tap changer with actuators according to FIG. 4 that are fastened to an inner wall of the oil tank.

FIG. 5 is a sectional view of a detail of the load selector with actuators 50 according to FIG. 4. The actuators 50 are fastened to the inner wall 20 of the oil tank 18. Here, the respective actuator 50 is mounted on the inner wall 20 of the oil tank 18 via the at least two bores 60 (see FIG. 4) and the at least one passage 62 (see FIG. 4) by a respective mounting element 31. The mounting elements 31 are mounted in such a way that in the embodiment shown here a diverter ring 391 and two tap contacts 392 are thus mounted on the inner surface 56 of the respective actuator 50. Other embodiments can also provide other arrangements of the diverter ring 391 or the diverter contacts 391 and tap contacts 392.

Each of the tap contacts 392 is in that case connected with a respective electrical terminal element 39 led to the outer wall 16 of the oil tank 18. In particular, as illustrated here, the diverter contact is preferably a diverter ring 391.

Figure 6:
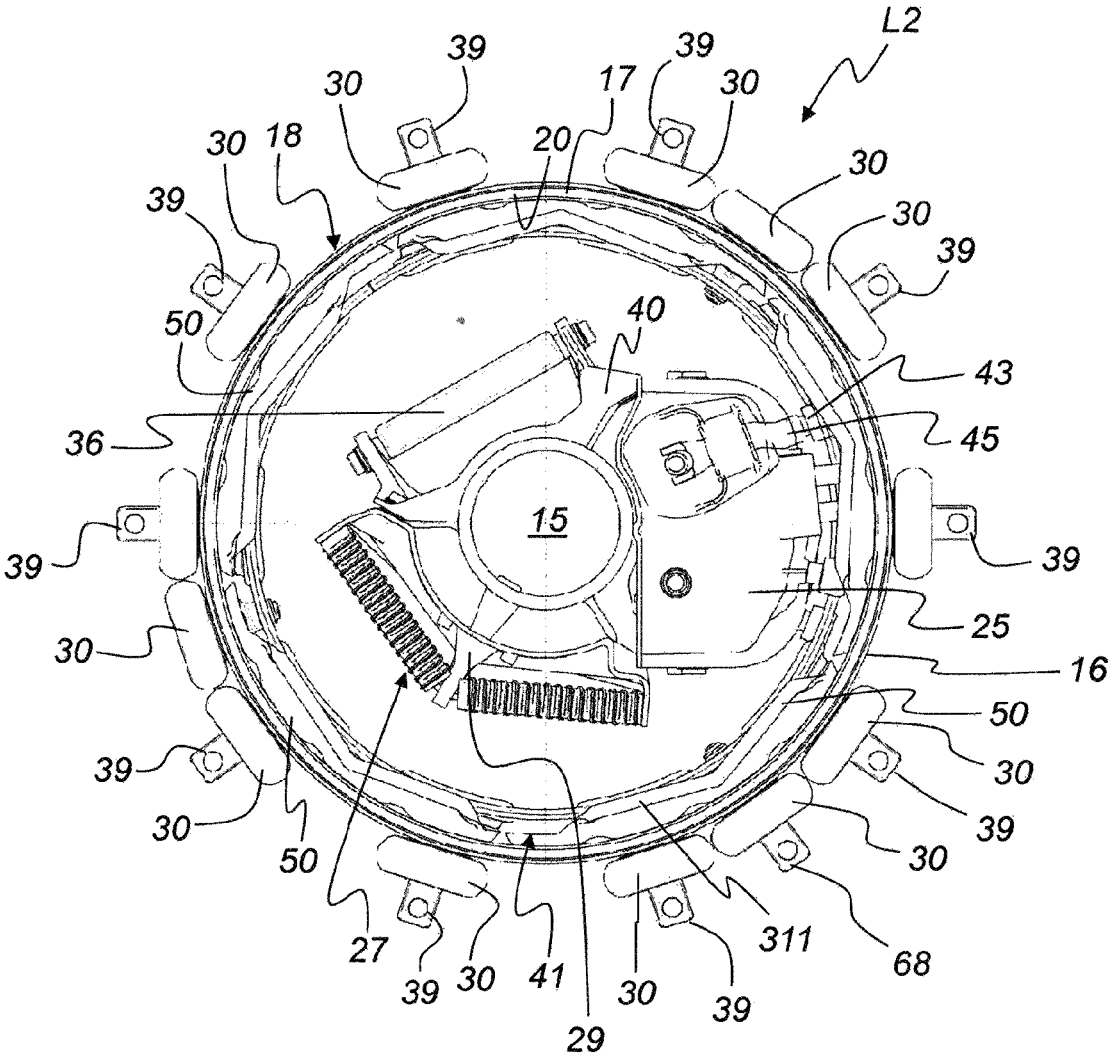
FIG. 6 is a sectional view of the load selector along the section line A-A shown in FIG. 1.

FIG. 6 is a sectional view along the section line A-A of FIG. 1 of the load selector 1, in which a plan view of the first phase L1 is illustrated. As shown here, seated on the inner wall 20 of the oil tank 18 for the first phase L1 are the actuators 50 that are matched to the contour of the inner wall 20 of the oil tank 18 and that represent the contact arrangement 41. The electrical terminal elements 39 for the tap contacts 392 (not illustrated here) and the electrical terminal element 68 for the diverter ring 391 (not illustrated here) pass through the corresponding actuators 50 and through the oil tank wall 17 of the oil tank 18 to the outer wall 16 thereof. The screening caps 30 at the outer wall 16 of the oil tank 18 mount the actuators 50 at the inner wall 20 of the oil tank 18. For that purpose, the electrical terminal elements 39 for the tap contacts 392 and the electrical terminal element 68 for the diverter ring 391 so cooperate by the mounting elements 31 (not illustrated here, see FIG. 5) with the associated screening caps 30 that the actuators 50 are mounted on the inner wall 20 of the oil tank 18. The screening caps 30 lie on the outer wall 16 of the oil tank 18. Each of the actuators 50 comprises the upper control cam 51 and the lower control cam 52 (see, with respect thereto, FIG. 5) so as to cooperate with corresponding actuating levers 45 that are provided with rollers 43, of the switching segment 25 of the corresponding phase L1, L2, L3.

Figure 7:
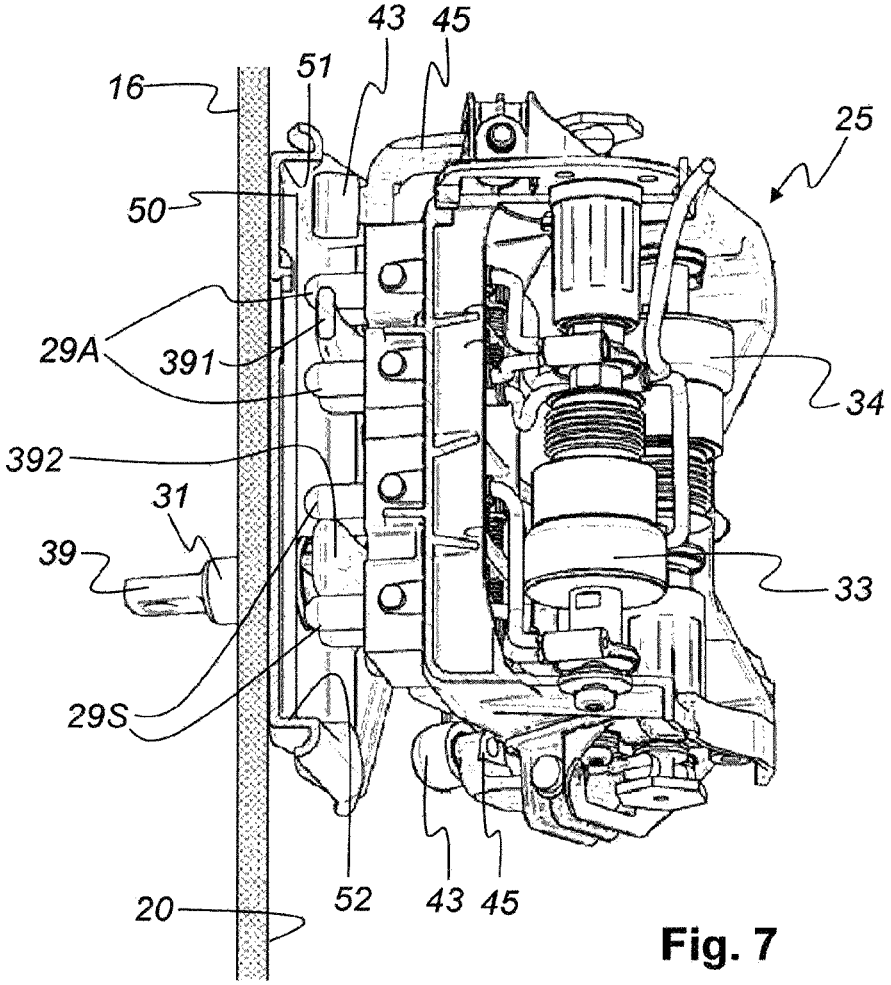
FIG. 7 is a perspective view of a switching segment that cooperates with the corresponding control cams of the actuator arranged at the inner wall of the oil tank, wherein parts of the wall of the switching segment are omitted so as to illustrate the internal construction.

In addition, the switching tube 15 comprises in each phase L1, L2, L3 a mount 40 at which, apart from the resistor subassembly 27 and the switching segment 25, a high-mass element 36 is mounted radially about the axis A of the switching tube 15. The switching segment 25 is in that case mounted by its movable contacts 29S for tap contacts 392 and movable contacts 29A for diverter contacts 391 (see FIG. 7) in such a way that the rollers 43 of the actuating levers 45 cooperate with corresponding upper or lower control cams 51, 52 of the actuators 50 in order to actuate two vacuum interrupters 33, 34 in each switching segment 25. FIG. 7 shows this in a perspective view. Since all further reference numerals illustrated here have already been explained in the preceding descriptions with respect to FIGS. 1 to 6, a repeated description at this point is dispensed with.

Figure 8:
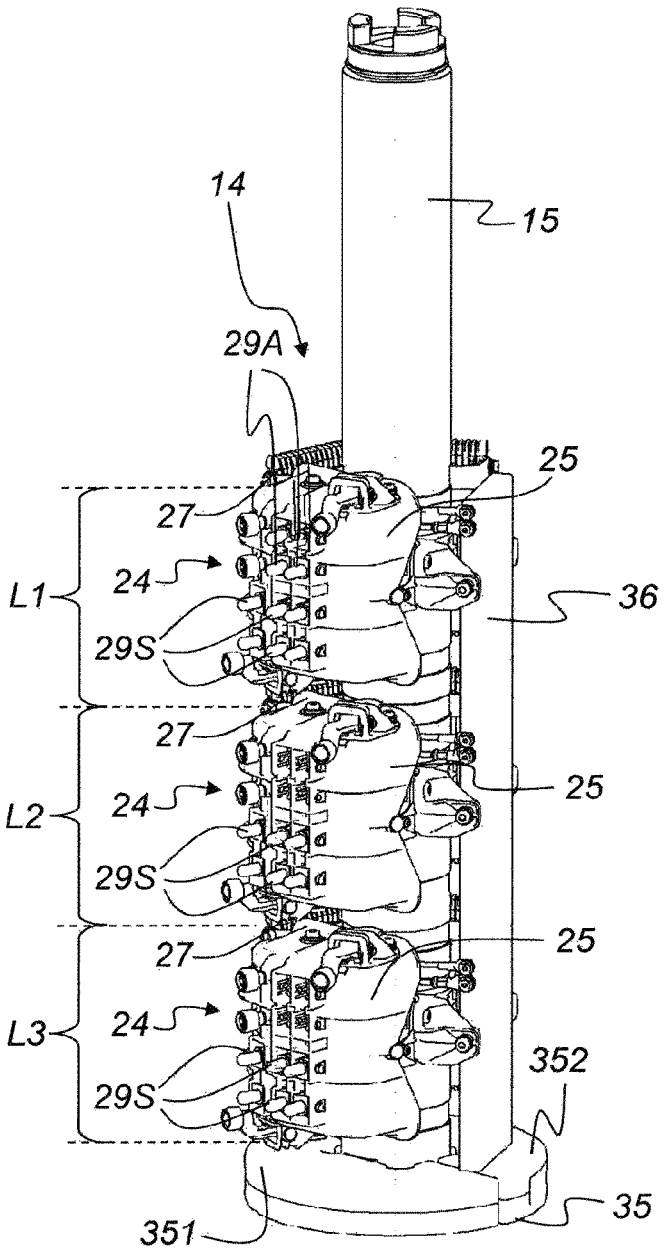
FIG. 8 is a perspective view of the load changeover switch insert of the three-phase load selector according to FIG. 1, in which the three switching segments fastened to the switching tube and the high-mass element can be seen and in which the switching tube carries a first flywheel mass part and a second flywheel mass part of a flywheel mass.
Figure 9:
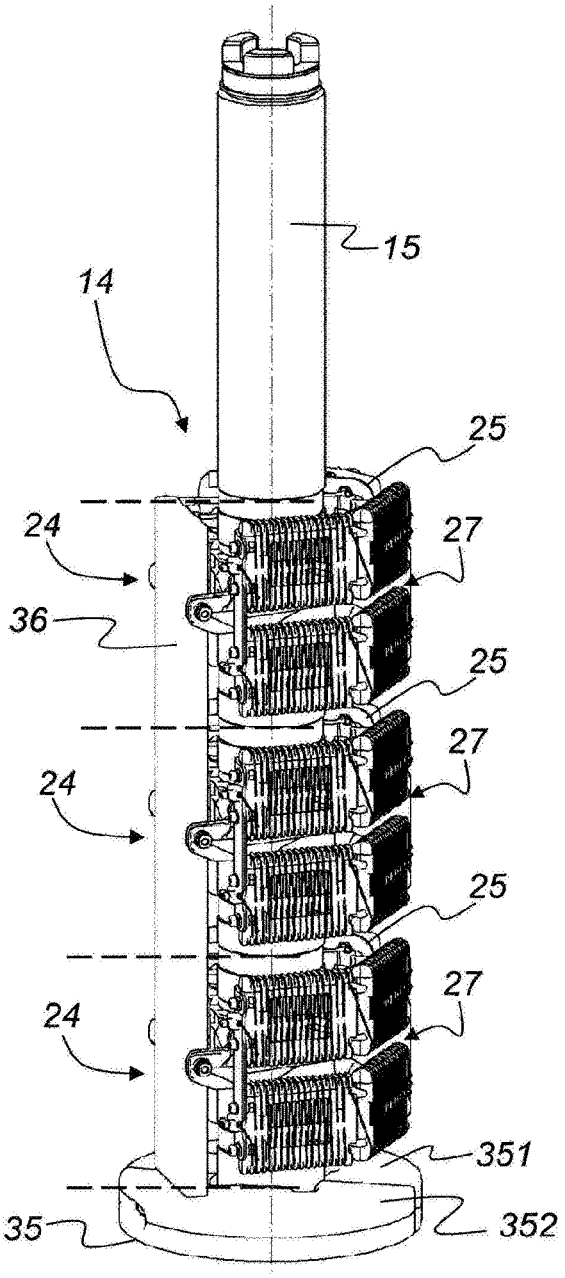
FIG. 9 is a further perspective view of the load changeover switch insert of the three-phase load selector according to FIG. 1, in which the three resistor subassemblies fastened to the switching tube and the two flywheel mass parts mounted on the switching tube in accordance with FIG. 8 are illustrated.

As shown in further perspective views of the load selector 1 according to the invention in FIGS. 8 and 9, this comprises, in a preferred embodiment a flywheel mass 35. This preferably consists of a first flywheel mass part 351 and a second flywheel mass part 352 and additionally carries the high-mass element 36. This high-mass element 36 and the flywheel mass 35 are needed for assisting the movement sequence over time of the switching process so that the triggering, which produces rotation of the switching tube 15, of the force-storing unit executes a defined switching or defined setting of the individual switching states of the load selector. It is apparent from FIGS. 8 and 9 that the load changeover switch insert 14 consists of three identical switching modules 24. Each switching module 24 carries the switching segment 25 and the resistor subassembly 27 at the switching tube 15.

Figure 10:
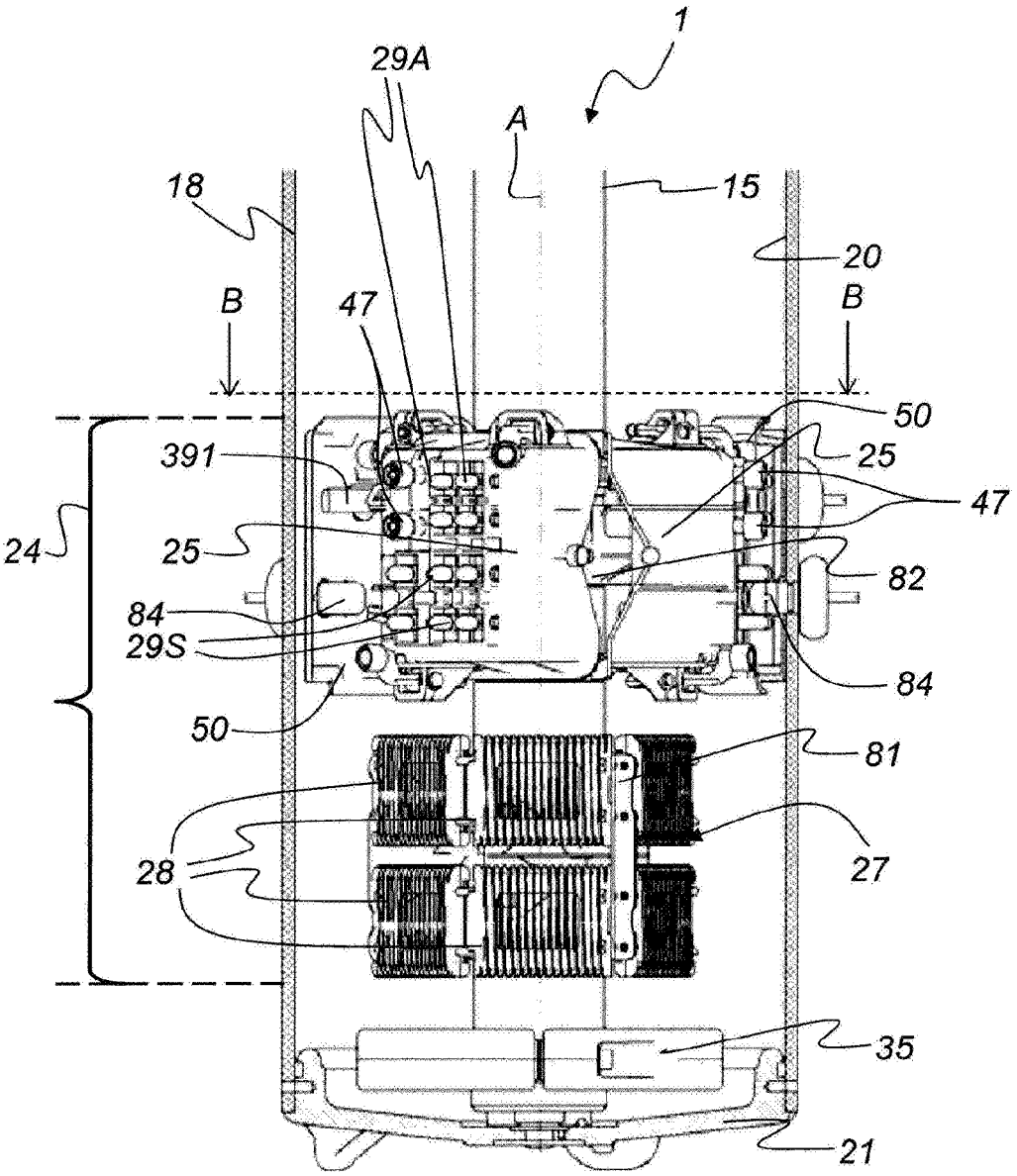
FIG. 10 is a perspective sectional view for illustration of the internal construction of an on-load tap changer according to the invention in the form of a three-phase load changeover switch.

FIG. 10 is a sectional view for clarification of the internal construction of an on-load tap changer according to the invention in the form of a three-phase load changeover switch 1. The load changeover switch 1 similarly comprises a switching tube 15 rotatable about an axis A. Here, too, the switching segments 25 and the individual identical resistors 28 that are combined in identical resistor subassemblies 27, are to be regarded as switching modules 24 that are similarly fastened, as in the case of the load selector described in the previous FIGS. 1 to 9, to the switching tube 15. Each resistor subassembly 27 comprises the several and identical resistors 28 that here, too, are seated in a sector-shaped support 29 (see FIG. 3).

In the embodiment of the load changeover switch 1 illustrated here three identical resistor subassemblies 27 with sector-shaped support 29 and the identical resistors 28 are so arranged per switching module 24 around the axis A of the switching tube 15 that the arrangement of the identical resistor subassemblies 27 surrounds the switching tube 15. The disposition of the identical resistor subassemblies 27 is spaced in the direction of the axis A of the switching tube 15 from the three switching segments 25 that are similarly mounted around the switching tube 15. As in the case of a load selector, here in the load changeover switch 1 as well several actuators 50 are mounted at the inner wall 20 of the oil tank 18 of the load changeover switch 1 in accordance with the mode and manner already described in FIG. 4.

Each of the switching segments 25 comprises a plurality of contacts 29S for electrical contacting of the selector contacts 84 that are constructionally identical with the tap contacts 392 of the load selector of FIG. 7. Equally, the switching segment 25 carries a plurality of movable contacts 29A for the diverter contact 391 that in this embodiment is a ring segment of the diverter ring. The diverter contact 391 also functions as a guide segment. For this purpose, provided at the switching segment 25 are guide rollers 47 that engage above and below the guide segment and thus guide the switching segments 25 during rotation of the switching tube 15.

The switching tube 15 of the load changeover switch 1 according to the invention carries a first mounting device 81 for the resistors 28, so that the resulting resistor subassembly 27 surrounds the switching tube 15. In addition, here the switching tube 15 carries, in axial direction, a second mounting device 82 that carries the three switching segments 25 around the switching tube 15.

Figure 11:
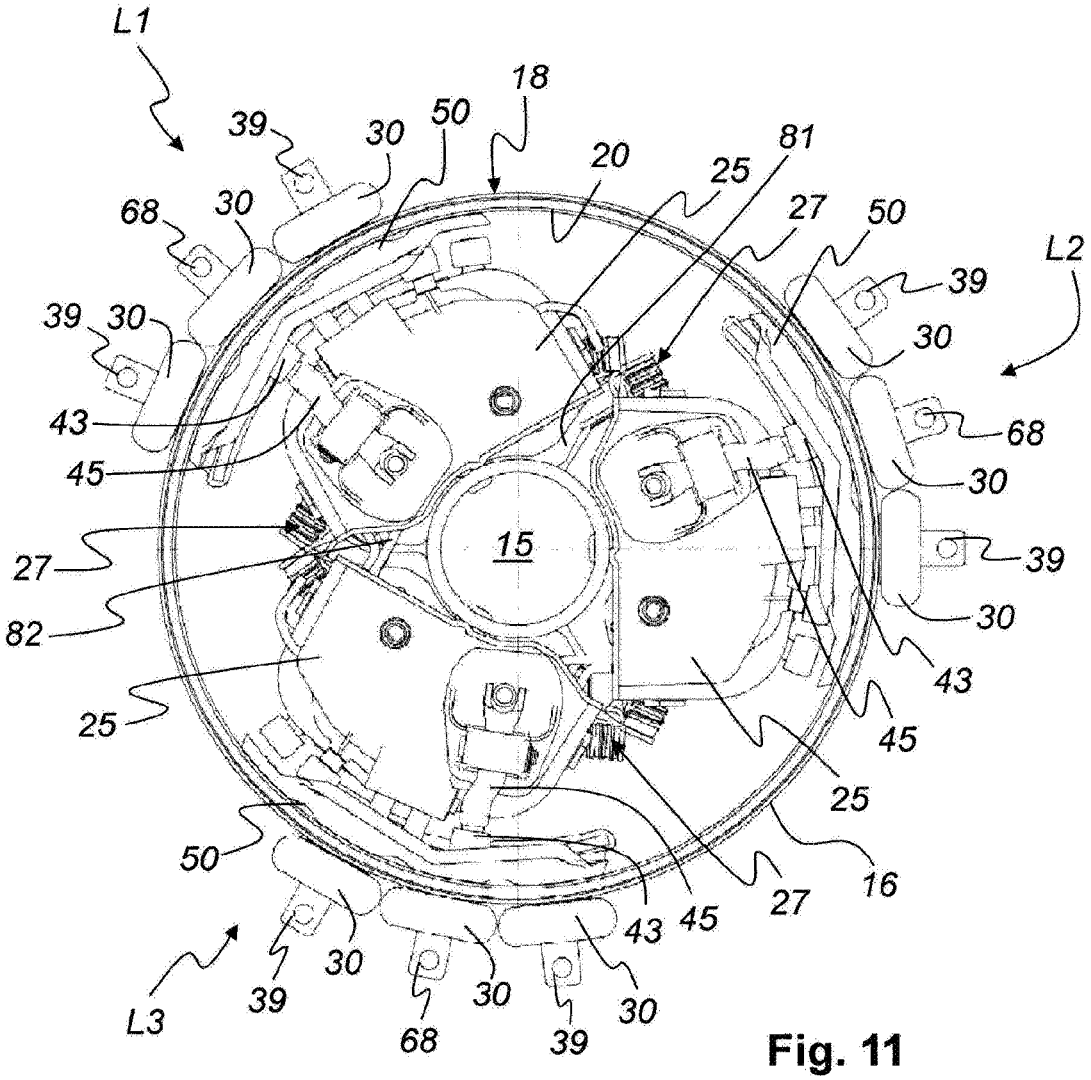
FIG. 11 is a sectional view of the load changeover switch along the section line B-B shown in FIG. 10.

FIG. 11 is a sectional view of the load changeover switch 1 along the section line B-B shown in FIG. 10. Arranged around the switching tube 15 are three identical switching segments 25, each of which cooperates with an associated actuator 50 at the inner wall 20 of the oil tank 18. The three actuators 50 form the actuating arrangement 41. As explained in the description with respect to FIG. 4, each actuator 50 has an upper control cam 51 and a lower control cam 52. Each of the switching segments 25 comprises two vacuum interrupters (not illustrated here), each of which cooperates with an actuating lever 45 that carries a roller 43. The rollers 43 cooperate with the upper control cam 51 or the lower control cam 52. The switching module 24 comprises in each of the first phase L1, second phase L2 and third phase L3 a respective switching segment 25 and a resistor subassembly 27 thereunder. Provided in each of the phases L1, L2 or L3 is a respective actuator 50 that has the form illustrated in FIG. 4 and is similarly used in the load selector 1 illustrated in FIG. 6. The electrical terminal elements 85, 86 for the selector contact 84 (see FIG. 10) and the electrical terminal elements 68 for the diverter contact 391 pass through the actuators 50 and through the oil tank wall 17 of the oil tank 18 to the outer wall 16 thereof. The electrical terminal element 68 of the respective diverter contact 391 and the electrical terminal element 39 of the respective tap contact 392 are in addition led through the respective screening caps 30 to the outer wall 16 of the oil tank 18.

The invention claimed is:

1. An on-load tap changer comprising:

a load changeover switch insert having a switching tube rotatable about an axis;

at least one switching module associated with the switching insert and having at least one switching segment fastened to the switching tube;

an oil tank;

a resistor subassembly having a plurality of separate and identical resistors; and an actuating arrangement associated with the switching module at an inner wall of the oil tank and having a plurality of identical actuators that are associated with the switching module at the inner wall of the oil tank, the on-load tap changer being a load selector or a load changeover switch depending on the arrangement of the at least one identical switching segment, the resistor subassembly, and the mounting of the plurality of identical actuators at the inner wall of the oil tank of the on-load tap changer.

2. The on-load tap changer according to claim 1, wherein the resistor subassembly has a sector-shaped support holding the identical resistors.

3. The on-load tap changer according to claim 1, wherein each of the identical actuators has a plurality of bores and a plurality of passages for fastening to the inner wall of the oil tank and is formed with an upper control cam and a lower control cam.

4. The on-load tap changer according to claim 1, wherein each switching segment comprises two vacuum interrupters each having a respective actuating lever, a plurality of movable contacts for a diverter contact and a plurality of movable contacts for tap or selector contacts.

5. The on-load tap changer according to claim 2, wherein the sector-shaped support of the resistor subassembly, a switching segment and a high-mass element are arranged in the switching module around the axis of the switching tube and corresponding actuators are so mounted on the inner wall of the oil tank that the on-load tap changer is a load selector.

6. The on-load tap changer according to claim 5, wherein the switching tube carries a mount that carries a switching segment, the resistor subassembly, and the high-mass element radially about the axis of the switching tube.

7. The on-load tap changer according to claim 5, wherein the load selector has three of the switching modules mounted on the switching tube along the axis.

8. The on-load tap changer according to claim 2, wherein three of the sector-shaped supports of the identical resistor subassemblies are so arranged in the switching module around the axis of the switching tube as to surround the switching tube, three of the switching segments are mounted angularly spaced around the switching tube relative to the axis of the switching tube and at a spacing from the resistor subassembly, and respective actuators are so mounted on the inner wall of the oil tank that the on-load tap changer is a load changeover switch.

9. The on-load tap changer according to claim 8, wherein the switching tube carries a first mounting device for the resistor subassemblies so that the resistor subassemblies surround the switching tube and the switching tube carries a second mounting device that carries the three switching segments around the switching tube.

10. The on-load tap changer according to claim 8, wherein the load changeover switch comprises three switching segments mounted on the switching tube angularly around the axis.

11. The on-load tap changer according to claim 3, wherein each actuating lever of the switching segment carries a respective roller that cooperates with the upper control cam or the lower control cam of the respective actuator.

12. The on-load tap changer according to claim 1, wherein at least one diverter contact and at least one tap contact or selector contact are each connected by a respective mounting element at an inner surface of each actuator and are mounted on an outer wall of the oil tank and an electrical terminal element of the respective diverter contact or an electrical terminal element of the respective tap contact or respective selector contact extends through a screening cap to the outer wall of the oil tank.

13. The on-load tap changer according to claim 12, wherein by virtue of the arrangement of at least the switching segments and the resistor subassemblies the on-load tap changer is a load selector and the diverter contact is constructed as a continuous diverter ring.

14. The on-load tap changer according to claim 12, wherein by virtue of the arrangement of at least the switching segments and the resistor subassemblies the on-load tap changer is a load changeover switch and the diverter contact is a ring segment.

15. The on-load tap changer according to claim 1, further comprising:

a flywheel mass mounted on the switching tube.

* * * * *